US009863205B2

(12) United States Patent
Levert, Jr. et al.

(10) Patent No.: US 9,863,205 B2
(45) Date of Patent: Jan. 9, 2018

(54) RUNNING TOOL WITH OVERSHOT SLEEVE

(71) Applicant: Cameron International Corporation, Houston, TX (US)

(72) Inventors: Michael F. Levert, Jr., Sugar Land, TX (US); James D. Cavanagh, Cedar Park, TX (US); Andrew R. Hanson, Cypress, TX (US)

(73) Assignee: Cameron International Corporation, Houston, TX (US)

( * ) Notice: Subject to any disclaimer, the term of this patent is extended or adjusted under 35 U.S.C. 154(b) by 956 days.

(21) Appl. No.: 14/095,832

(22) Filed: Dec. 3, 2013

(65) Prior Publication Data

US 2015/0152701 A1 Jun. 4, 2015

(51) Int. Cl.
*E21B 33/04* (2006.01)

(52) U.S. Cl.
CPC ..... *E21B 33/04* (2013.01)

(58) Field of Classification Search
CPC combination set(s) only.
See application file for complete search history.

(56) References Cited

U.S. PATENT DOCUMENTS

| | | | | |
|---|---|---|---|---|
| 2,879,849 | A * | 3/1959 | Le Bus, Sr. | E21B 31/00 175/315 |
| 3,871,449 | A * | 3/1975 | Ahlstone | E21B 33/043 166/183 |
| 2004/0065434 | A1* | 4/2004 | Bland | E21B 33/0415 166/78.1 |
| 2010/0051261 | A1 | 3/2010 | Koleilat et al. | |
| 2011/0226487 | A1 | 9/2011 | Vanderford et al. | |
| 2012/0305269 | A1 | 12/2012 | Bories et al. | |
| 2013/0056282 | A1 | 3/2013 | Robottom | |

OTHER PUBLICATIONS

Hanson et al., U.S. Appl. No. 13/867,947, filed Apr. 22, 2013.

* cited by examiner

*Primary Examiner* — Giovanna C. Wright
*Assistant Examiner* — Ronald R Runyan
(74) *Attorney, Agent, or Firm* — Eubanks PLLC

(57) ABSTRACT

A running tool with an overshot sleeve is provided. In one embodiment, a system includes a running tool and an overshot sleeve including a first portion threaded onto the running tool and a second portion. The first portion and the second portion are connected together in a manner that allows the first portion and the second portion to rotate with respect to one another. The second portion of the sleeve can engage an additional component, such as a casing hanger, and the running tool and the overshot sleeve can be configured to selectively convert rotation of the running tool into axial motion of the overshot sleeve with respect to the running tool. Additional systems, devices, and methods are also disclosed.

16 Claims, 11 Drawing Sheets

RUNNING TOOL WITH OVERSHOT SLEEVE

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in finding and extracting oil, natural gas, and other subterranean resources from the earth. Particularly, once a desired subterranean resource such as oil or natural gas is discovered, drilling and production systems are often used to access and extract the resource. These systems may be located onshore or offshore depending on the location of a desired resource. Further, such systems generally include a wellhead assembly mounted on a well through which the resource is accessed or extracted. These wellhead assemblies can include a wide variety of components, such as various spools, casings, valves, pumps, fluid conduits, and the like, that facilitate drilling or extraction operations.

As will be appreciated, wells are often lined with casings that generally serve to stabilize the wells and to isolate fluids within the wellbores from certain formations penetrated by the wells (e.g., to prevent contamination of freshwater reservoirs). In many instances, such casings are coupled to wellheads via hangers installed in bores of the wellheads. Running tools can be inserted into the bores to install or otherwise interact with such hangers or other components in the wellheads.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Embodiments of the present disclosure generally relate to running tools for installing or otherwise interacting with wellbore components, such as casing hangers. In one embodiment, an overshot sleeve is provided with a running tool to facilitate installation of a wellbore component and disconnection of the running tool from the wellbore component. The overshot sleeve can include a swivel that allows one end of the sleeve to rotate with respect to the other end. The running tool and the overshot sleeve can cooperate to translate rotational motion of the running tool into axial motion of the overshot sleeve. The overshot sleeve can transmit torque from the running tool to the wellbore component, and the axial motion of the overshot sleeve can be used to disengage the overshot sleeve from the wellbore component to facilitate disconnection of the running tool from the wellbore component.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

Specific embodiments of the present disclosure are described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
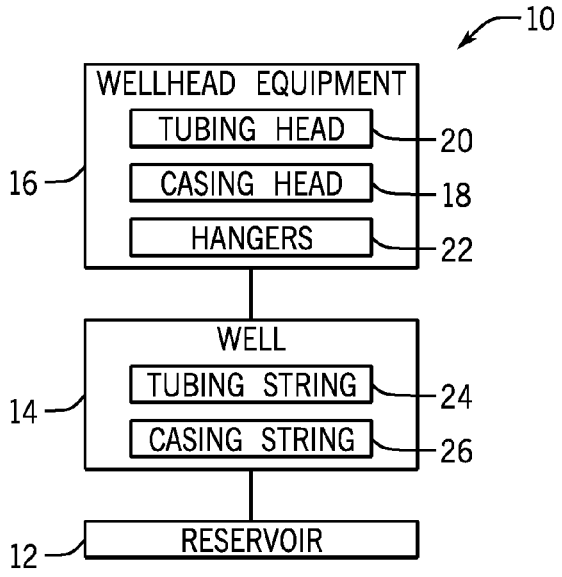
FIG. 1 generally depicts various components, including one or more casing strings and associated hangers, that can be installed at a well in accordance with one embodiment of the present disclosure.

Turning now to the present figures, a system 10 is illustrated in FIG. 1 in accordance with one embodiment. Notably, the system 10 is a production system that facilitates extraction of a resource, such as oil, from a reservoir 12 through a well 14. Wellhead equipment 16 is installed on the well 14. As depicted, the wellhead equipment 16 includes at least one casing head 18 and tubing head 20, as well as hangers 22. But the components of the wellhead equipment 16 can differ between applications, and could include a variety of casing heads, tubing heads, hangers, blowout preventers, stuffing boxes, pumping tees, and pressure gauges, to name only a few possibilities.

The hangers 22 can be positioned within the tubing and casing heads, and each of the hangers 22 can be connected to a tubing string 24 or a casing string 26 to suspend such strings within the well 14. The well 14 can include a single casing string 26 or include multiple casing strings 26 of different diameters. The hangers 22 can be installed in a wellhead with running tools.

Figure 2:
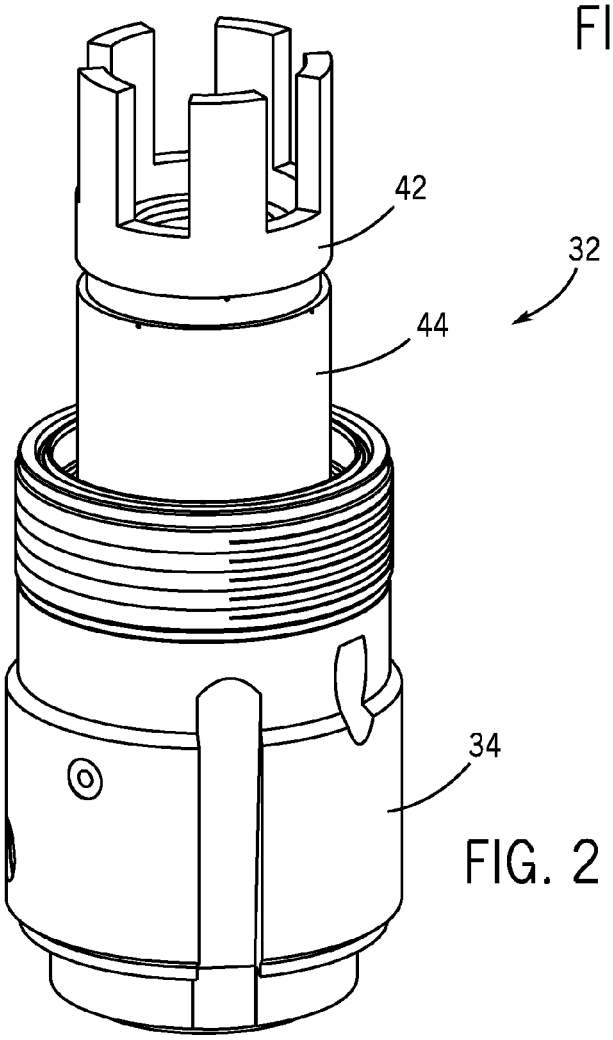
FIG. 2 is a perspective view of a running tool with an overshot sleeve disposed within a casing head in accordance with one embodiment.
Figure 3:
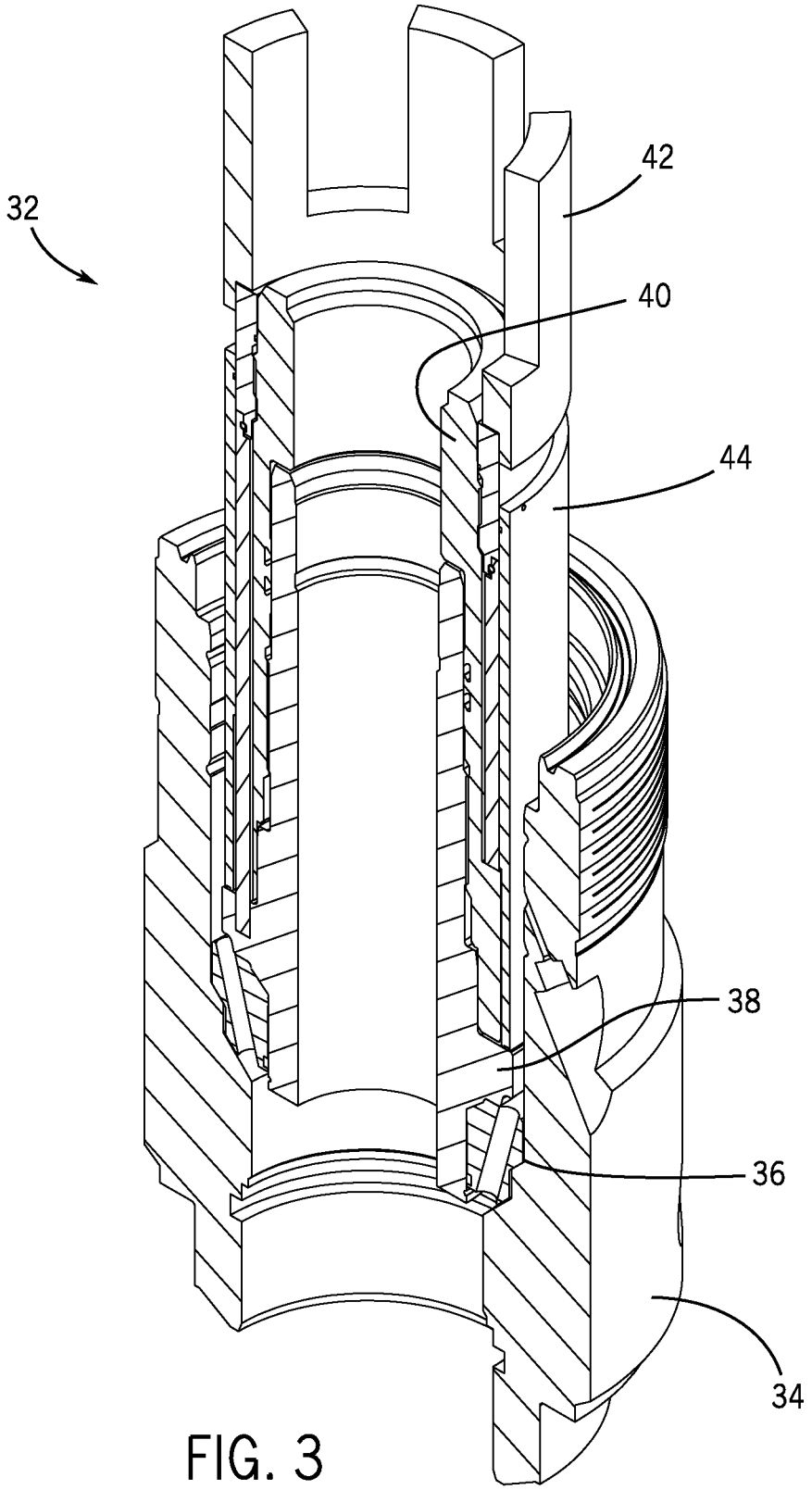
FIG. 3 is a sectional view of the running tool, overshot sleeve, and casing head of FIG. 2, further depicting the running tool coupled to a casing hanger in accordance with one embodiment.

One example of such a running tool is generally depicted in FIGS. 2 and 3. In this embodiment, apparatus 32 includes a casing head 34 that receives a landing ring 36 and a casing hanger 38 that is run into the bore of the casing head 34 with a running tool 40. The landing ring 36 is depicted here as separate from the casing hanger 38, but it will be appreciated that the casing hanger 38 could be constructed with an integral shoulder (rather than using a separate landing ring 36) for landing the casing hanger 38 directly on a mating shoulder of the casing head 34 in other embodiments. The apparatus 32 also includes a sleeve 42 connected to the running tool 40. As described below, the sleeve 42 engages the casing hanger 38 and transmits torque from the running tool 40 to the casing hanger 38, allowing rotation of the running tool 40 (e.g., by a top drive connected to the running tool 40 by a landing joint) to cause the sleeve 42 and the casing hanger 38 to also rotate. The depicted sleeve 42 gives the running tool 40 an overshot function and can thus be referred to as an overshot sleeve 42. A protective sleeve 44 is connected about the overshot sleeve 42 and, as also discussed below, may prevent debris from entering a swivel of the overshot sleeve 42. While specific examples of running tools with overshot sleeves used to install casing hangers are described herein, it will be appreciated that such running tools and overshot sleeves could be used to install or interact with other wellbore components as well.

Figure 4:
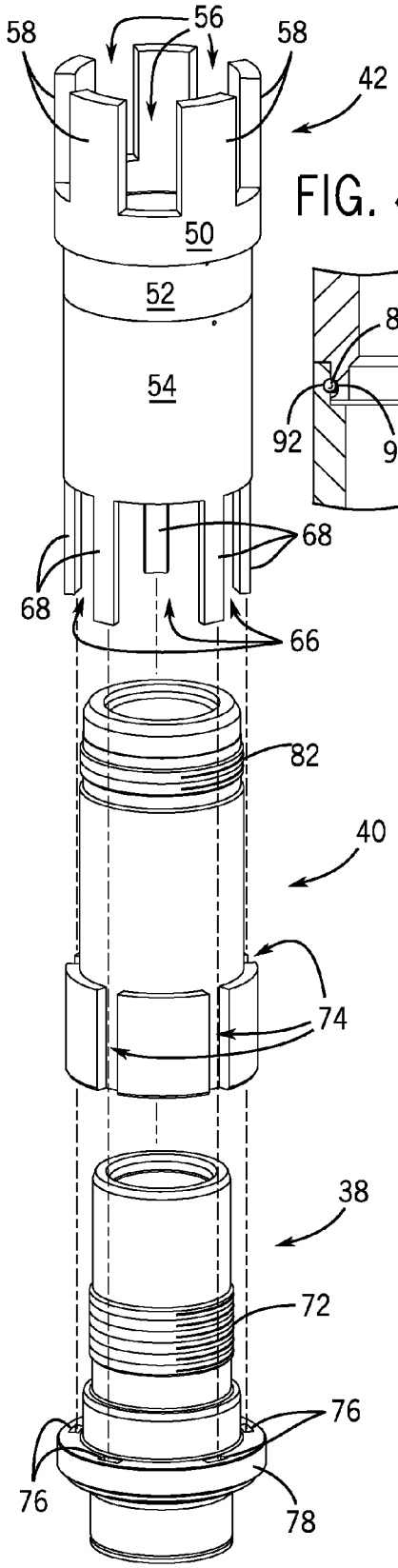
FIG. 4 is an exploded view of the casing hanger, running tool, and overshot sleeve of FIGS. 2 and 3 in accordance with one embodiment.
Figure 5:
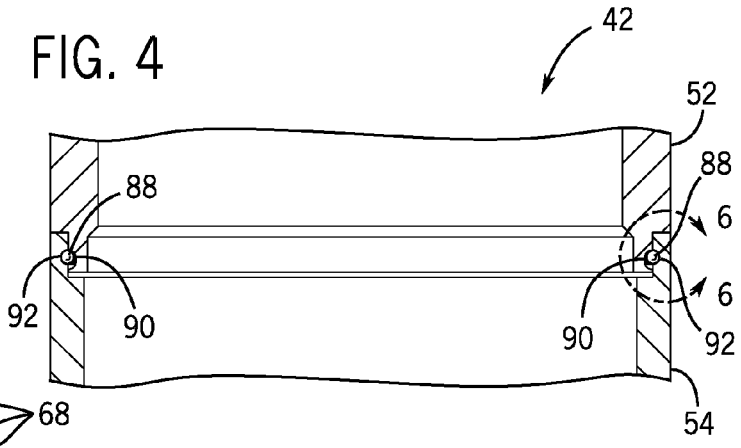
FIG. 5 is a detail view of a swivel of the overshot sleeve of FIGS. 2-4 that allows opposite ends of the sleeve to rotate with respect to one another in accordance with one embodiment.
Figure 6:
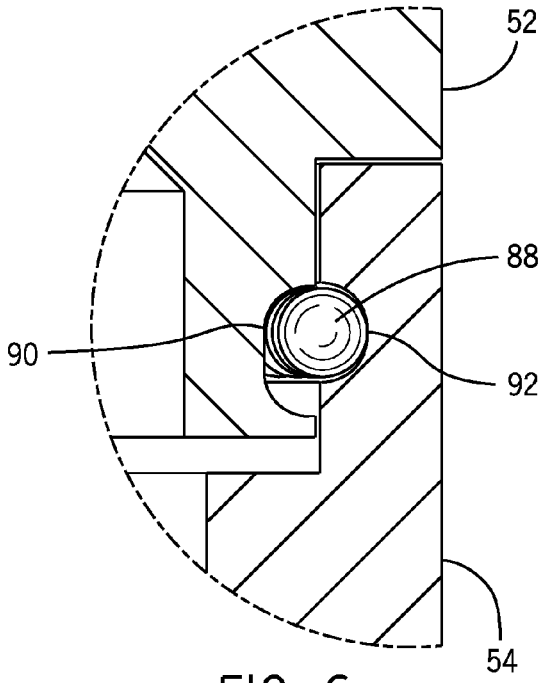
FIG. 6 is a detail view showing ball bearings within the swivel of FIG. 5 in accordance with one embodiment.

The assembly of the running tool 40 and the overshot sleeve 42 to the casing hanger 38 may be better understood with reference to the exploded view of these components provided in FIG. 4. In this depicted embodiment, the overshot sleeve 42 includes two portions connected by a swivel (e.g., ball bearings 88 in FIGS. 5 and 6). An upper portion of the overshot sleeve 42 is shown in FIG. 4 as including sleeve components 50 and 52, which can be fixed to one another in any suitable manner, such as with set screws. In other embodiments, the upper portion of the overshot sleeve 42 could be provided as a single component.

A lower portion 54 of the depicted overshot sleeve 42 is connected to the upper portion by the swivel, which can be provided in any suitable fashion. For example, in one embodiment generally shown in FIGS. 5 and 6, the swivel includes ball bearings 88 provided between an inner race 90 of the upper portion of the overshot sleeve 42 and an outer race 92 of the lower portion 54. The swivel allows opposing ends of the overshot sleeve 42 to rotate with respect to one another. Particularly, in at least some embodiments, the swivel allows one end of the sleeve 42 (e.g., the upper portion with components 50 and 52) to be held stationary while the other end of the sleeve 42 (e.g., lower portion 54) rotates with the running tool 40.

The upper portion of the sleeve 42 can be held stationary in any desired manner. In some embodiments, a wellbore penetration (e.g., a tie-down pin of a wellhead) can be used to engage the upper portion of the sleeve 42 to inhibit its rotation. The upper portion can include one or more slots for receiving such a pin. For example, as depicted in FIG. 4, the overshot sleeve 42 has slots 56 between projections 58 at the end of the upper portion. While the sleeve 42 is depicted as a castellated sleeve in FIG. 4, with open-ended slots 56 (i.e., extending to and open at a distal end of the sleeve 42) provided between projections 58 in the form of castellations, other embodiments could have a different arrangement. The slots 56 could be provided as closed slots that are not open at the distal end of the sleeve 42, for instance, or the upper end of the sleeve 42 could have one or two projections extending axially from the end of the sleeve to engage a pin extending into the wellbore from the wellhead.

The lower portion 54 of the overshot sleeve 42 includes additional slots 66 between projections 68 Like those of the upper portion of the sleeve 42, the projections 68 are here depicted as castellations extending from an end of the sleeve 42, but could differ in other embodiments. For example, a different number of projections 68 (which could include a single projection 68 or a pair of projections 68 in some embodiments) can be provided. When the sleeve 42 is assembled with the running tool 40 and the casing hanger 38, the projections 68 extend axially through slots 74 of the running tool 40 and into slots 76 of the casing hanger 38. More specifically, the running tool 40 can be threaded onto the casing hanger 38 via threaded surface 72 and the slots 74 and 76 can be aligned with one another to allow the projections 68 to be inserted through the slots 74 of the running tool 40 and into the slots 76 of the casing hanger 38. The swivel in the sleeve 42 allows the projections 68 of the lower portion 54 to be inserted axially through the slots 74 and into the slots 76 while threading the upper portion (e.g., sleeve component 52) onto the running tool 40 via threaded surface 82. As shown in FIG. 4, the slots 74 are formed in an exterior surface of the running tool 40 and the slots 76 are provided in a flange 78 of the casing hanger 38, although the configuration and number of the slots 74 and 76 (which may also be referred to as recesses 74 and 76) can differ in other embodiments.

Figure 7:
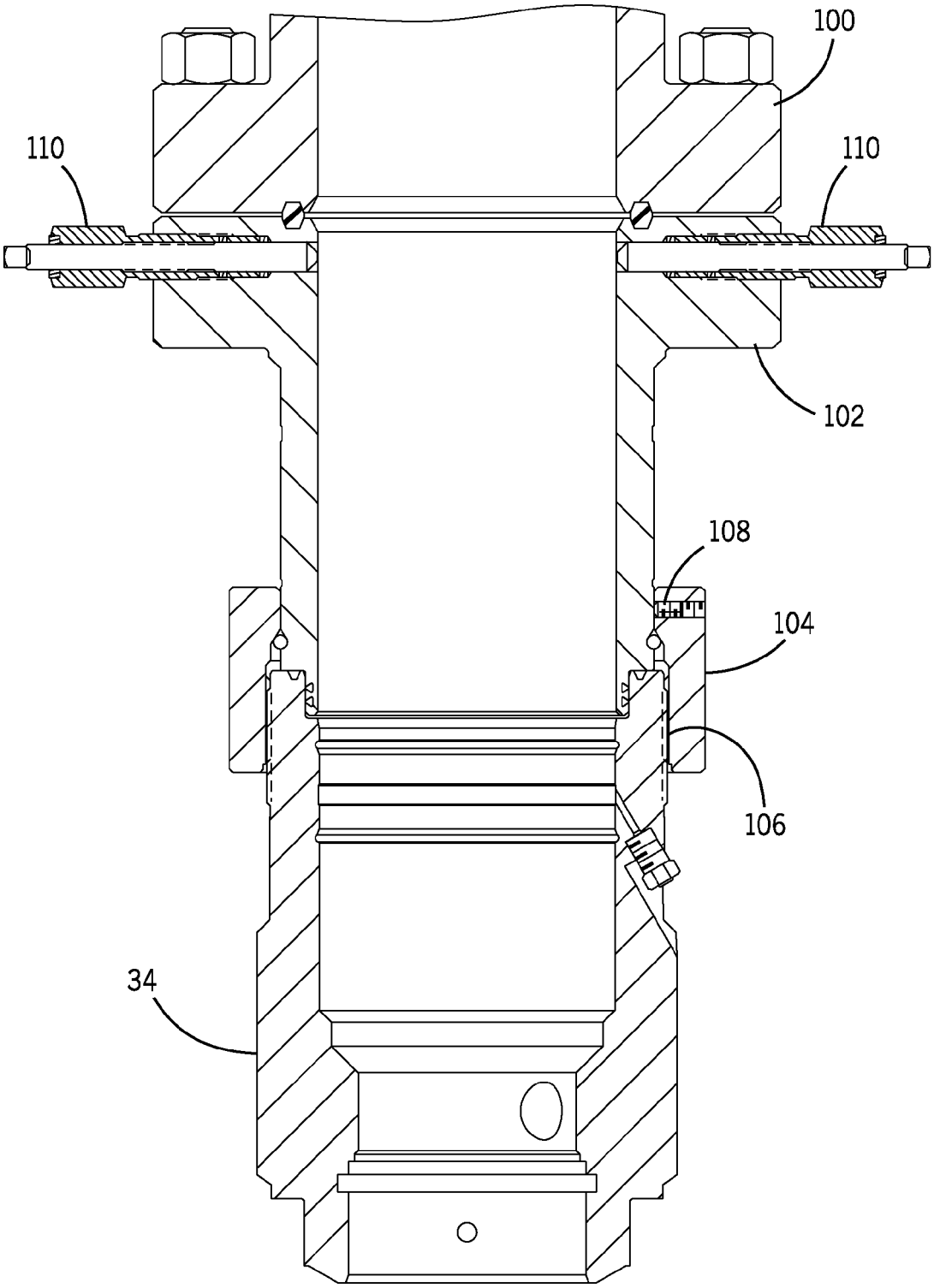
FIG. 7 is a cross-section of a portion of a blowout preventer stack connected to the casing head with an adapter spool in accordance with one embodiment.

Operation of the running tool 40 and the sleeve 42 to install the casing hanger 38 in a wellhead (e.g., in casing head 34) may be better understood with reference to FIGS. 7-12. In this example, a blowout preventer stack 100 is coupled to the casing head 34 via an adapter spool 102 and connection collar 104, as generally shown in FIG. 7. The collar 104 is connected to the casing head 34 with a threaded interface 106. One or more set screws 108 inhibit rotation of the collar 104 once installed on the casing head 34. Pins 110 (e.g., tie-down pins or lock screws) are provided in the adapter spool 102 or elsewhere in the wellhead. These pins 110 are initially retracted from the wellbore so as to not interfere with the casing hanger 38, the running tool 40, and the sleeves 42 and 44 as they are run into the wellbore through the blowout preventer stack 100.

Figure 8:
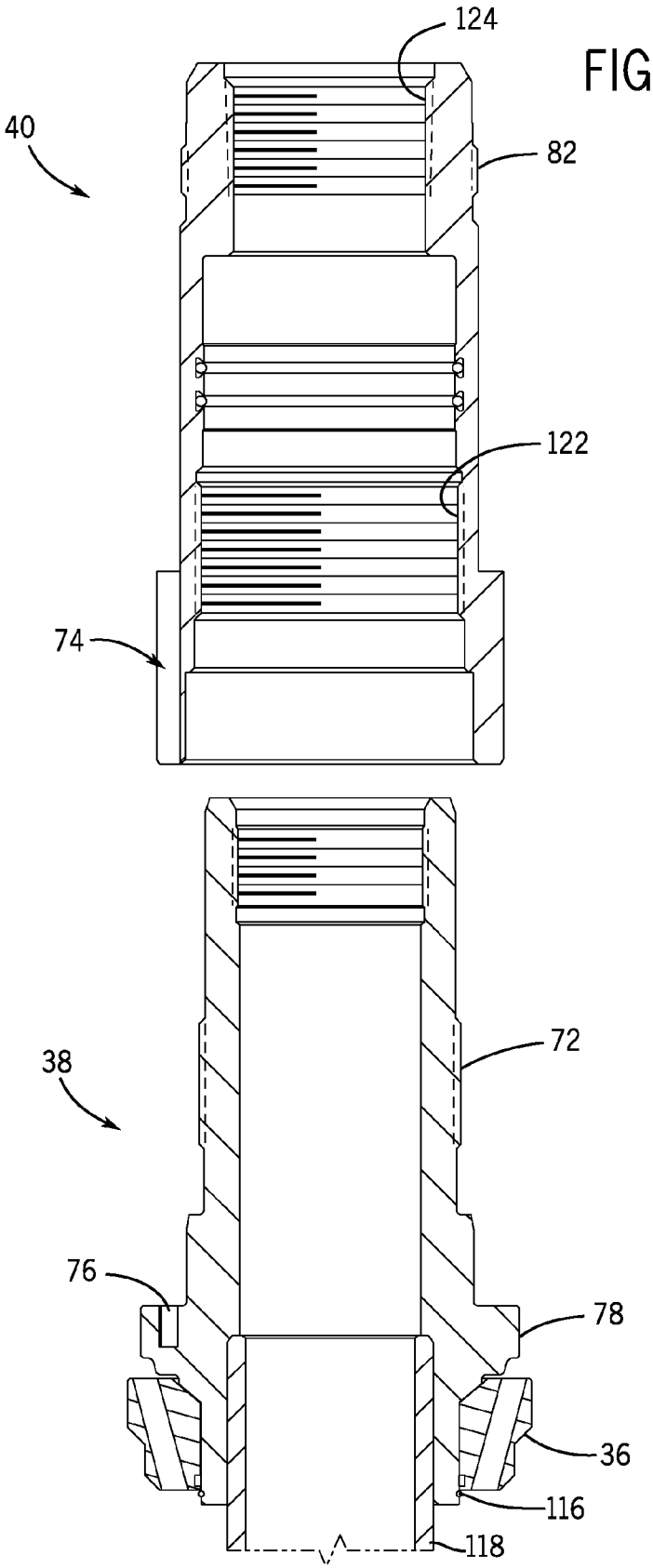
FIG. 8 is a cross-section of the casing hanger and the running tool of FIG. 4 in accordance with one embodiment.

The casing hanger 38, the running tool 40, and the sleeves 42 and 44 can be assembled before running these components into the wellbore. As depicted in FIG. 8, the landing ring 36 can be retained to the casing hanger 38 with retaining wire 116 and the casing hanger 38 is threaded onto a casing joint 118 (e.g., a pup joint). The running tool 40 includes an inner threaded surface 122 that mates with the outer threaded surface 72 of the casing hanger 38, allowing the running tool 40 to be threaded onto the casing hanger 38 via these threaded surfaces. The running tool 40 also includes an inner threaded surface 124 for receiving a landing joint 132 (FIG. 9).

Figure 9:
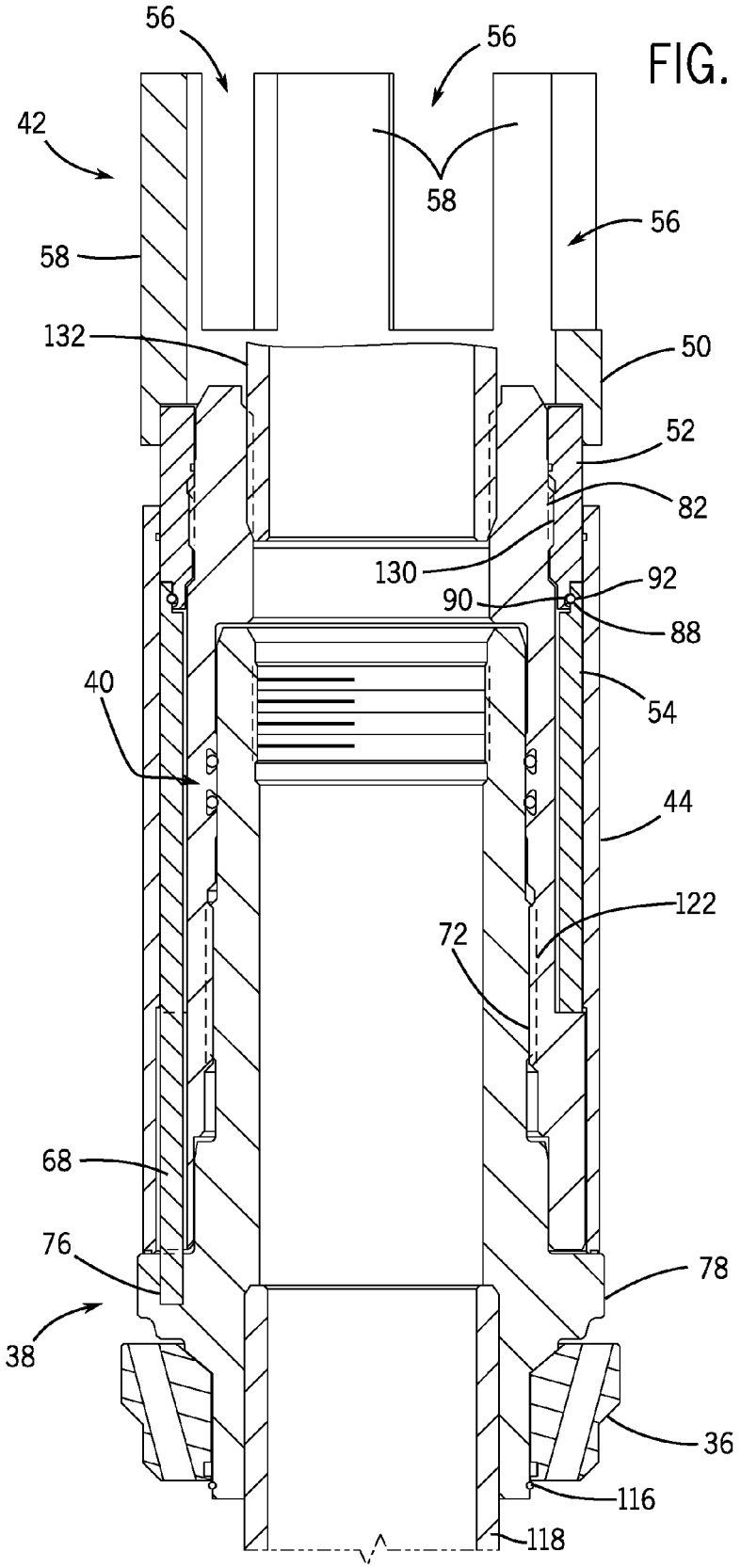
FIG. 9 is a cross-section of the casing hanger and the running tool of FIG. 8 assembled together with the overshot sleeve of FIG. 4 in accordance with one embodiment.

Once the running tool 40 is threaded onto the casing hanger 38, the slots 74 and 76 can be aligned and the sleeves 42 and 44 can be installed on running tool 40, as generally depicted in FIG. 9. The protective sleeve 44 can be connected to the overshot sleeve 42 before installing the overshot sleeve 42 on the running tool 40. For example, the protective sleeve 44 can be fastened to the sleeve component 52 with set screws. The protective sleeve 44 is positioned about the overshot sleeve 42 radially outward from the swivel (e.g., the ball bearings 88) to protect the swivel from debris. The protective sleeve 44 shown here extends along most of the outer surface of the overshot sleeve 42. But in other embodiments, the protective sleeve 44 could be provided as a shorter sleeve surrounding the swivel.

The overshot sleeve 42 includes a threaded surface 130 that mates with a threaded surface 82 of the running tool 40, allowing the overshot sleeve 42 to be threaded onto the running tool 40 via these surfaces. As generally noted above, the swivel of the sleeve 42 allows the one or more projections 68 of the lower portion 54 to be axially inserted into the slots 74 and 76 as the upper portion of the sleeve 42 is threaded onto the running tool 40.

In at least some embodiments, the threaded surfaces 82 and 122 of the running tool 40 are threaded in opposite directions. For example, the threaded surface 122 of the running tool 40 and the mating threaded surface 72 of the casing hanger 38 could be provided with left-handed threads, while the threaded surface 82 of the running tool 40 and its mating threaded surface 130 of the overshot sleeve 42 could be provided with right-handed threads. In such an embodiment, the running tool 40 could be rotated counterclockwise to thread the running tool 40 to the casing hanger 38, and the overshot sleeve 42 could be rotated clockwise to thread the sleeve 42 onto the running tool 40. In another embodiment, however, the threads and directions of rotation could be reversed.

Figure 10:
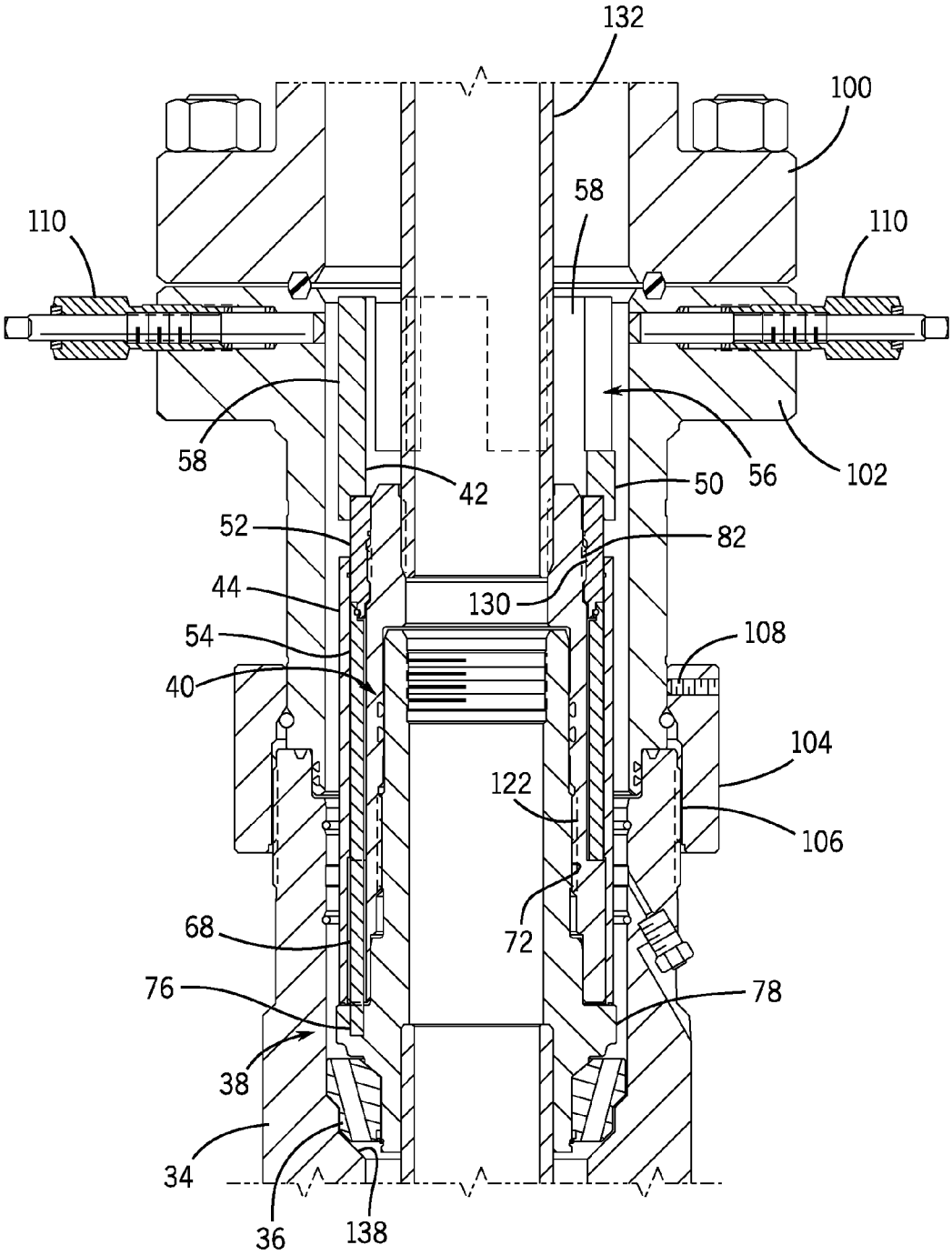
FIG. 10 depicts the casing hanger, running tool, and overshot sleeve of FIG. 9 inserted into the casing head through the blowout preventer stack in accordance with one embodiment.

The landing ring 36, the casing hanger 38, the running tool 40, and the sleeves 42 and 44 can be inserted (e.g., via landing joint 132) through the blowout preventer stack 100 and the adapter spool 102 into the wellbore inside the casing head 34. As shown in FIG. 10, the inserted assembly can be landed on a shoulder 138 inside the bore. In the present figure, the assembly is landed on the shoulder 138 via the separate landing ring 36, but in other embodiments in which the casing hanger 38 has an integral shoulder and no separate landing ring 36 the casing hanger 38 could be landed directly on the shoulder 138. The landing joint 132 can be rotated (e.g., by a top drive) to rotate the assembly within the bore. Torque from the rotating landing joint 132 is transmitted to the running tool 40, causing the running tool 40 to also rotate. The running tool 40 transmits torque to the projections 68 within the slots 74, causing the sleeve 42 to rotate with the running tool 40. Because the projections 68 are also received in slots 76 of the casing hanger 38, the projections 68 transmit torque to the casing hanger 38. This causes the casing hanger 38 (and an attached casing string 26 including joint 118) to also rotate with the sleeve 42 and the running tool 40.

Figure 11:
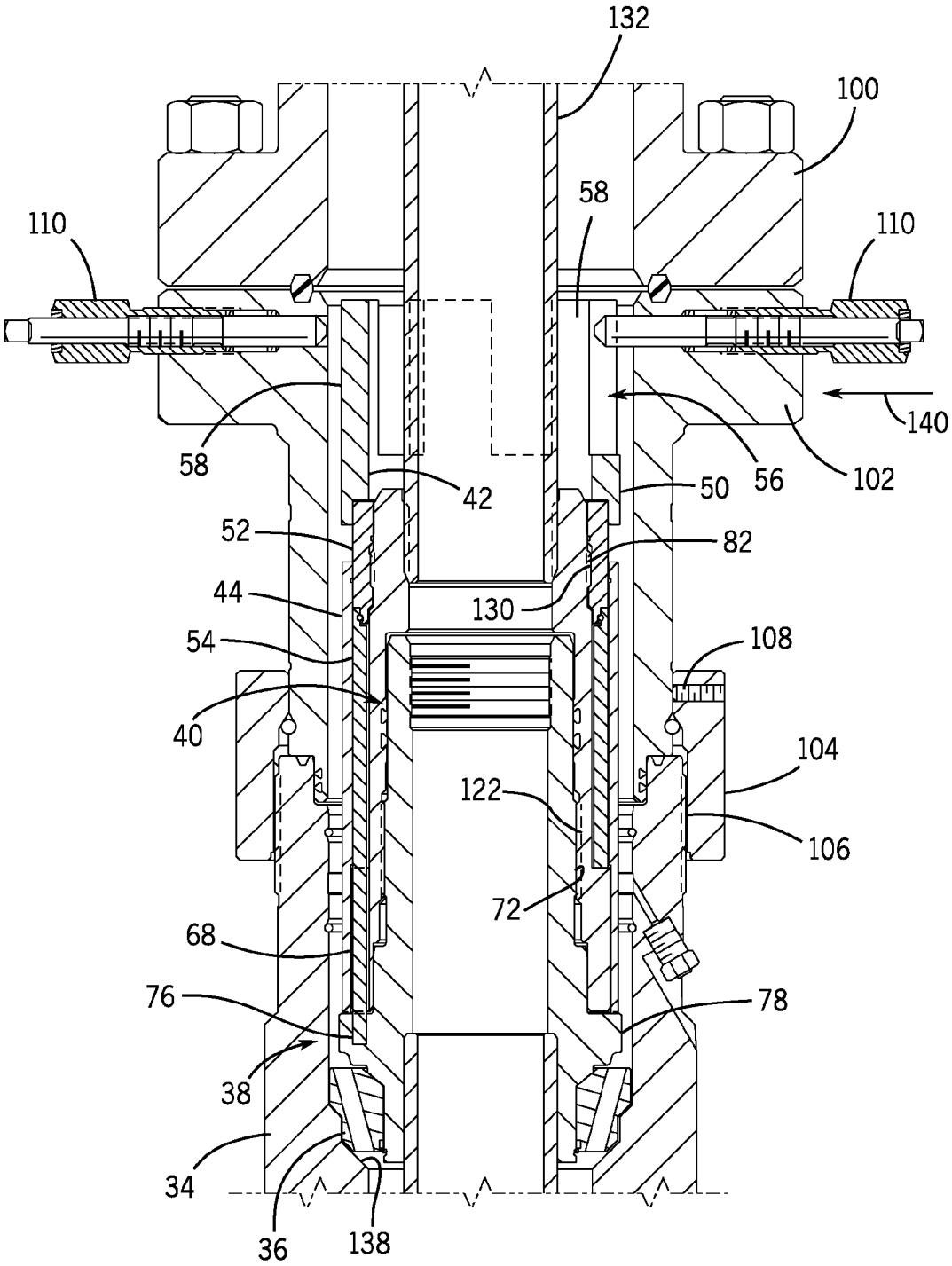
FIG. 11 generally depicts the extension of a tie-down pin of the casing head into the bore of the wellhead to inhibit rotation of an upper portion of the overshot sleeve in accordance with one embodiment.
Figure 12:
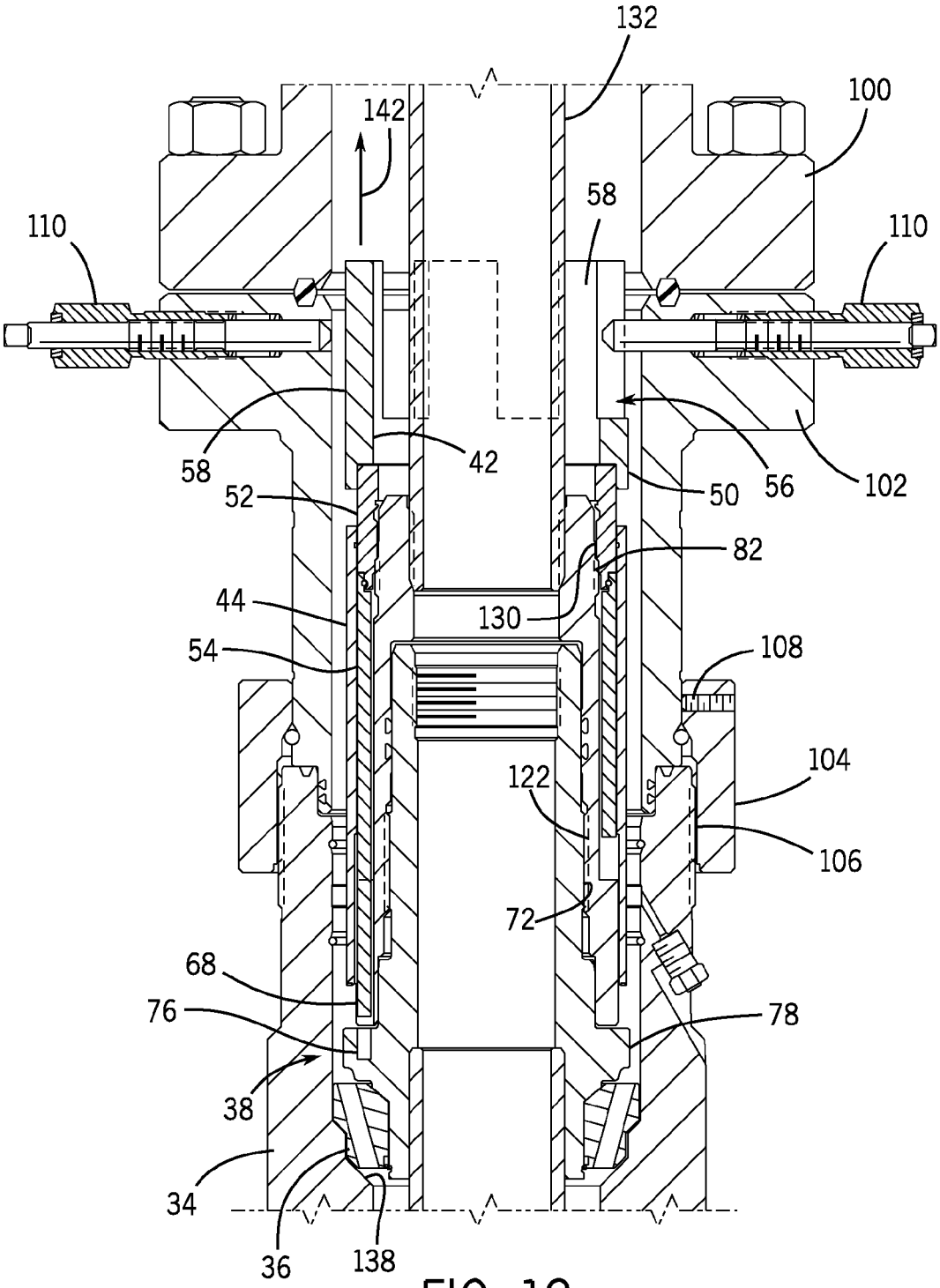
FIG. 12 generally depicts axial movement of the overshot sleeve with respect to the running tool that occurs upon rotating the running tool and a lower portion of the overshot sleeve while inhibiting rotation of the upper portion of the overshot sleeve, causing the overshot sleeve to disengage from the casing hanger, in accordance with one embodiment.

Once the casing hanger 38 is set in the bore and the running tool 40 is to be removed, one or more of the pins 110 can be extended into the wellbore to engage the upper portion of the overshot sleeve 42. As shown in FIG. 11, one of the pins 110 can be pushed inward (as generally represented by arrow 140) to enter a slot 56 between projections 58. The inserted pin 110 inhibits rotation of the upper portion of the sleeve 42, but does not interfere with rotation of the lower portion 54 of the sleeve 42. The running tool 40 can be rotated after the pin 110 is inserted. When the upper portion of the sleeve 42 is prevented from rotating with the running tool 40, rotation of the running tool 40 with respect to the upper portion of the sleeve 42 (e.g., clockwise rotation of the running tool 40 in the case of right-handed threaded surfaces 82 and 130) causes the sleeve 42 to translate axially along the running tool 40, as generally represented by arrow 142) until the projections 68 disengage the casing hanger 38 (e.g., until the projections 68 are pulled out of the recesses 76 of the casing hanger 38). In this manner, rotational motion of the running tool 40 is selectively translated into axial motion of the sleeve 42.

As will be appreciated, the projections 68 operate to pin the running tool 40 to the casing hanger 38 and enable synchronous rotation of the casing hanger 38 with the running tool 40 and the sleeve 42. Once the projections 68 clear the recesses 76 they no longer transmit torque to the casing hanger 38, allowing continued rotation of the running tool 40 (e.g., clockwise rotation of the running sleeve 40 in the case of left-handed threaded surfaces 72 and 122) to cause the running tool 40 to unthread from the casing hanger 38. This allows the running tool 40 and the sleeve 42 to be disconnected from the casing hanger 38 and removed from the wellhead without disconnecting the blowout preventer stack 100 from the casing head 34 and without requiring a separate tool or pressure line to be run into the wellbore to facilitate disconnection of the running tool 40.

Figure 13:
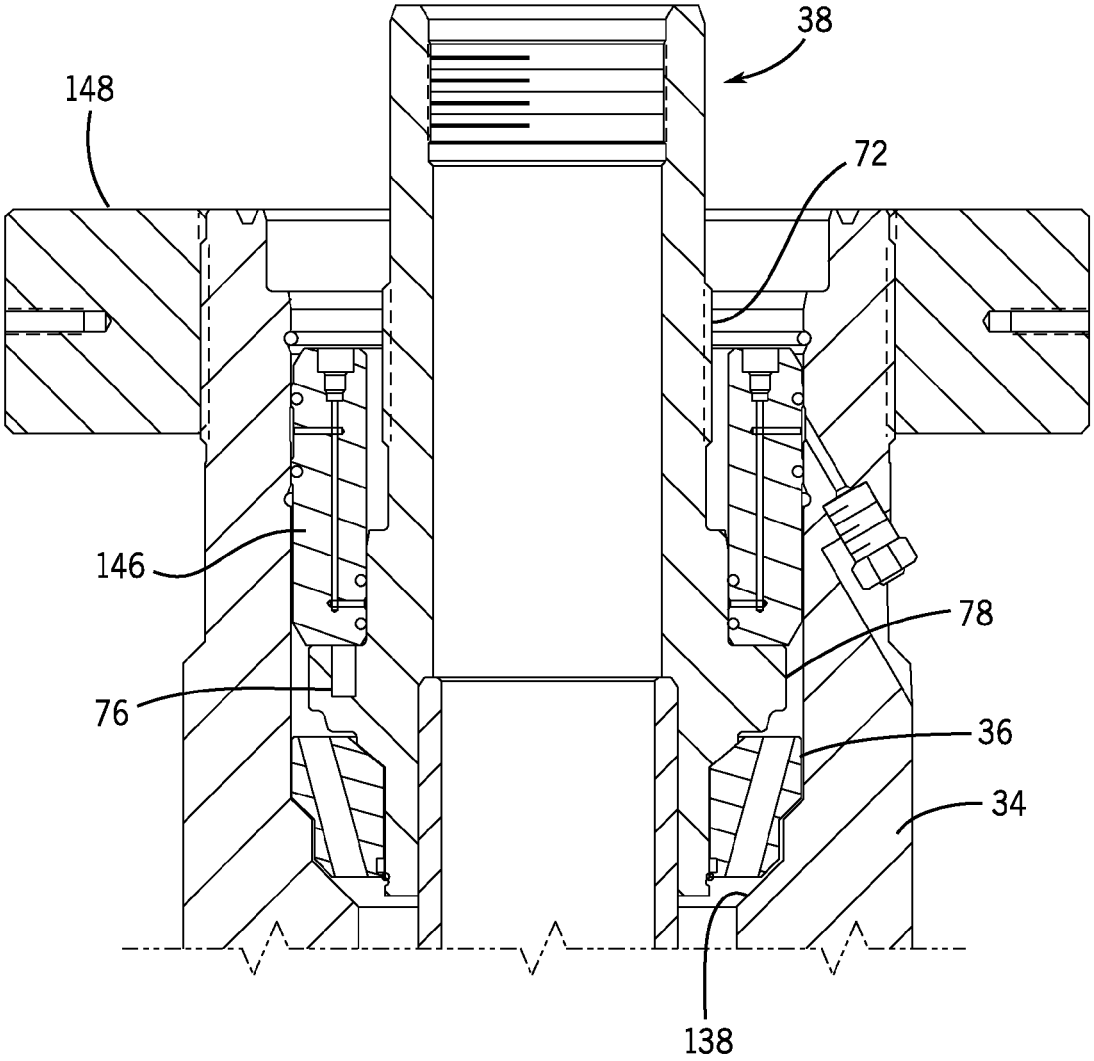
FIG. 13 illustrates a packoff installed in the casing head following removal of the running tool and overshot sleeve in accordance with one embodiment.
Figure 14:
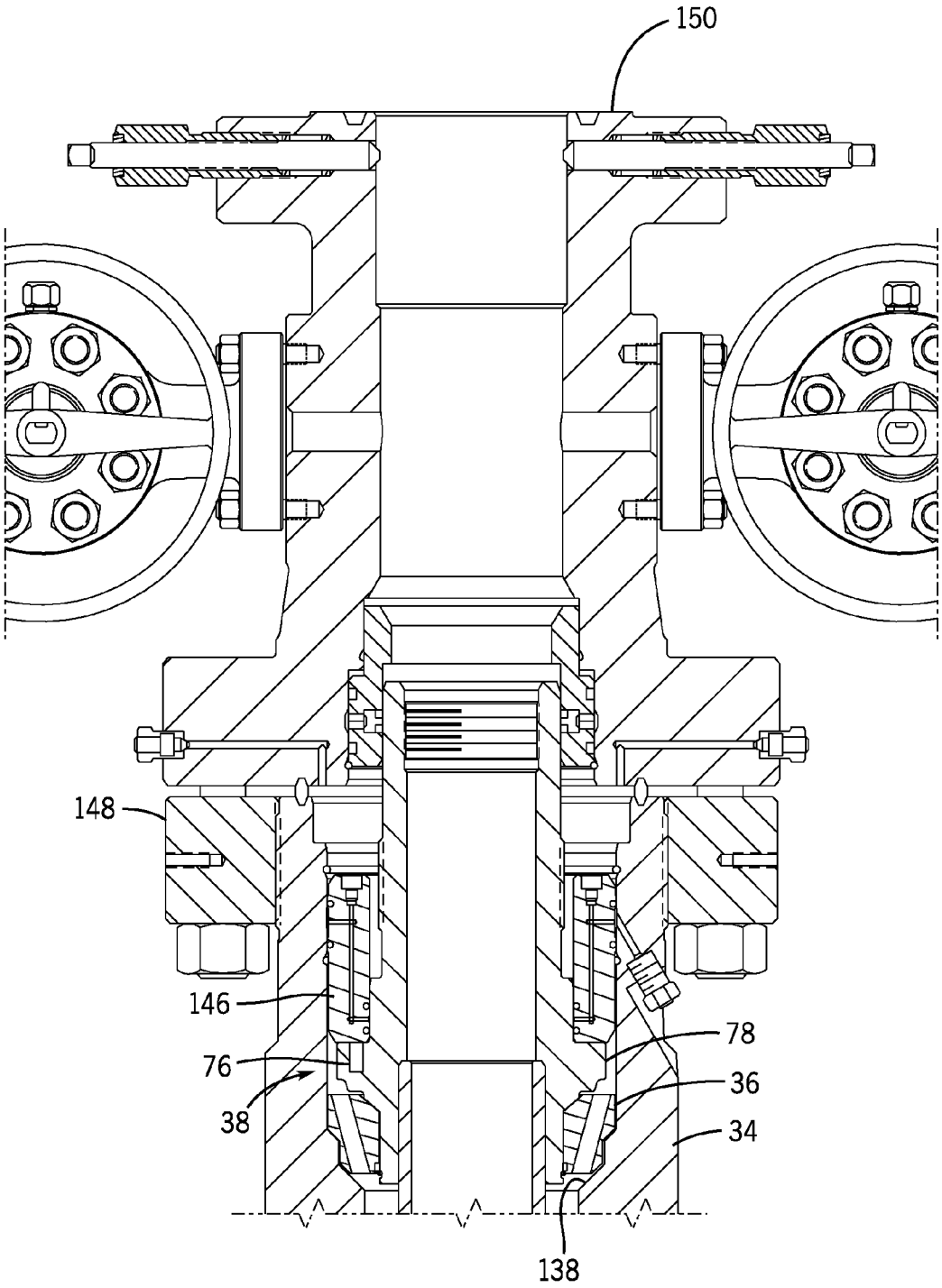
FIG. 14 depicts a tubing head coupled to the casing head in accordance with one embodiment.

After removing the running tool 40 (and its connected sleeves 42 and 44) from the bore, the blowout preventer stack 100 and adapter spool 102 can be removed from the casing head 34. A packoff 146 can then be installed in the bore to seal the annulus about the casing hanger 38, as generally depicted in FIG. 13. A threaded flange 148 can also be connected to the casing head 34 to enable other wellhead components to be installed on the casing head 34, such as a tubing head 150 as shown in FIG. 14.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A method comprising:

inserting a running tool connected to a casing hanger and to a sleeve into a wellhead, wherein the running tool is connected to the casing hanger and to the sleeve such that, upon rotation of the running tool, torque is transmitted from the running tool to the casing hanger via the sleeve to cause the casing hanger and the sleeve to rotate synchronously with the running tool;

engaging a first portion of the sleeve so as to inhibit rotation of the first portion of the sleeve within the wellhead while permitting rotation of a second portion of the sleeve, relative to the first portion of the sleeve, with the running tool and the casing hanger within the wellhead;

rotating the running tool and the second portion of the sleeve while inhibiting rotation of the first portion of the sleeve to cause the sleeve to move axially along the running tool and to disengage from the casing hanger such that torque is no longer transmitted from the running tool to the casing hanger via the sleeve; and once the sleeve has disengaged from the casing hanger, rotating the running tool within the wellhead to disconnect the running tool from the casing hanger.

2. The method of claim 1, wherein rotating the running tool and the second portion of the sleeve while inhibiting rotation of the first portion of the sleeve causes a projection of the sleeve to be withdrawn from a recess of the casing hanger.

3. The method of claim 2, comprising:

connecting the running tool to the casing hanger;

aligning a slot of the running tool with the recess of the casing hanger after connecting the running tool to the casing hanger; and connecting the sleeve to the running tool, wherein connecting the sleeve includes inserting the projection of the sleeve through the slot of the running tool and into the recess of the casing hanger in a manner that enables the projection to transmit torque from the running tool to the casing hanger.

4. The method of claim 3, wherein connecting the running tool to the casing hanger includes threading the running tool onto the casing hanger by rotating the running tool in a first direction with respect to the casing hanger and connecting the sleeve to the running tool includes threading the first portion of the sleeve onto the running tool by rotating the first portion of the sleeve in a second direction opposite the first direction.

5. The method of claim 1, wherein engaging the first portion of the sleeve so as to inhibit rotation of the first portion of the sleeve while permitting rotation of the second portion of the sleeve with the running tool and the casing hanger includes extending a pin in the wellhead to engage a slot in the first portion of the sleeve so as to inhibit rotation of the first portion of the sleeve.

6. The method of claim 1, comprising rotating both the first portion and the second portion of the sleeve with the running tool before engaging the first portion of the sleeve so as to inhibit rotation of the first portion of the sleeve while permitting rotation of the second portion of the sleeve with the running tool and the casing hanger.

7. The method of claim 1, wherein rotating the running tool within the wellhead to disconnect the running tool from the casing hanger includes rotating the running tool in the same direction as when rotating the running tool and the second portion of the sleeve to cause the sleeve to move axially along the running tool and to disengage the casing hanger.

8. A system comprising:

a running tool; and an overshot sleeve including a first portion threaded onto the running tool and a second portion, wherein the first portion and the second portion are connected together in a manner that allows the first portion and the second portion to rotate with respect to one another, and the second portion of the overshot sleeve includes a projection extending axially through a slot in the outer surface of the running tool.

9. The system of claim 8, wherein the running tool and the overshot sleeve are configured to selectively convert rotation of the running tool into axial motion of the overshot sleeve with respect to the running tool.

10. The system of claim 8, wherein the first portion of the overshot sleeve includes a castellated end.

11. The system of claim 8, comprising an additional component connected to the running tool, wherein the projection of the second portion of the overshot sleeve also extends into a recess in the additional component.

12. The system of claim 11, wherein the additional component includes a casing hanger.

13. The system of claim 8, wherein the first portion and the second portion of the overshot sleeve are connected together by ball bearings.

14. The system of claim 13, comprising a protective sleeve positioned about the overshot sleeve radially outward from the ball bearings.

15. A system comprising:

a wellhead provided at a well;

a running tool disposed within a bore of the wellhead and connected to a wellbore component within the bore;

a sleeve connected to the running tool and in engagement with the wellbore component, the sleeve including a swivel that allows opposite ends of the sleeve to rotate with respect to one another; and a pin extending into the bore from the wellhead to engage one end of the sleeve and inhibit rotation of that one end;

wherein the wellhead includes a blowout preventer stack connected to a casing head, and wherein the sleeve and the running tool are configured to enable the sleeve to disengage from the wellbore component and the running tool to disconnect from the wellbore component without disconnecting the blowout preventer stack from the casing head.

16. The system of claim 15, wherein the wellbore component includes a casing hanger.

* * * * *